US006897747B2

(12) United States Patent
Brandon et al.

(10) Patent No.: US 6,897,747 B2
(45) Date of Patent: May 24, 2005

(54) CIRCUIT BREAKER

(76) Inventors: Joseph T. Brandon, 11 Overlook Dr., Anderson, IN (US) 46011; Tony C. Lin, No. 182 Mei-Sin St. Ni-Nung Li, Meinung, Kaohsiung Hsien, 843 (TW)

( * ) Notice: Subject to any disclaimer, the term of this patent is extended or adjusted under 35 U.S.C. 154(b) by 0 days.

(21) Appl. No.: 10/143,452

(22) Filed: May 10, 2002

(65) Prior Publication Data

US 2003/0210114 A1 Nov. 13, 2003

(51) Int. Cl.[7] ..... H01H 83/00
(52) U.S. Cl. ..... 335/17; 335/172
(58) Field of Search ..... 335/6, 17–18, 335/23–25, 35–42, 165–176, 202; 361/42–51

(56) References Cited

U.S. PATENT DOCUMENTS 4,550,360 A 10/1985 Dougherty
4,589,052 A 5/1986 Dougherty
4,631,625 A 12/1986 Alexander et al.
5,136,457 A 8/1992 Durivage, III
5,159,519 A 10/1992 Cassidy et al.
5,481,235 A * 1/1996 Heise et al. ..... 335/18
5,872,495 A * 2/1999 DiMarco et al. ..... 335/35
6,055,145 A 4/2000 Lagree et al.
6,279,115 B1 8/2001 Baumgärtl et al.

* cited by examiner

*Primary Examiner*—Lincoln Donovan
(74) *Attorney, Agent, or Firm*—Vincent J. Allen; Carstens & Cahoon, LLP

(57) ABSTRACT

A microprocessor-based circuit breaker includes a removable chip that defines the current rating or ground fault current for the breaker. The breaker includes mechanical components that trip to disconnect the load terminal from the line input. The mechanical components include a floating breaker arm, trigger and tripper lever that cooperate to control the tripping of the breaker. A spring between the breaker arm and trigger, together with cam surfaces defined in the breaker switch cooperate to form a floating linkage to control the position of the breaker arm during on/off activation and current fault conditions. The circuit breaker also includes multiple indicia to provide a visual indication of the type of fault condition sensed by the breaker.

8 Claims, 9 Drawing Sheets

CIRCUIT BREAKER

BACKGROUND OF THE INVENTION

The present invention relates to circuit breakers. In specific embodiments, the invention concerns microprocessor-controlled circuit breakers.

Electrical trip systems are designed to respond to a fault in an electrical supply system by disconnecting the supply from the electrical load. One common trip system uses an electromagnet to trip a breaker in response to a short circuit or an electrical overload. In this type of device, the electromagnet generates a magnetic field when current is flowing through the device. When the current exceeds a threshold level, the magnetic field trips a mechanism that causes the breaker contacts to move apart or disconnect, thereby "breaking" the circuit path.

As the electrical system demands have increased, the level of sophistication of circuit breakers as also increased. Processor-based tripping systems have been developed to provide more accurate and flexible circuit breaking capabilities. These microprocessor-based systems permit programming of many features of the breaker, such as current rating, calibration, and fault conditions, as well as storage of pre-fault data.

SUMMARY OF THE INVENTION

The present invention contemplates an electrical trip system or circuit breaker that provides multiple indicia of fault conditions. According to one protocol of the inventive circuit breaker, a short-circuit condition is signified by a red indicator in conjunction with movement of the breaker switch to a neutral position. An overload or phase failure condition is signified by a black indicator in conjunction with movement of the breaker switch to a neutral position. A ground fault condition yields a yellow indicator in conjunction with movement of the breaker switch to a neutral position. Under normal conditions, the indicator is black with the breaker switch in its "ON" position.

In one aspect of the invention, the current rating of the circuit breaker is determined by a user-selectable resistor chip that can be plugged into the processor for the circuit breaker. Likewise, the ground fault current can be established by a separate user-selectable resistor chip that is connected to the breaker processor.

In a further feature of the invention, the trip mechanism includes a floating breaker arm disposed between the breaker switch and a trigger. The trigger is held in its armed position by a tripping lever and is spring connected to the floating breaker arm. The breaker arm is electrically connected to the line input and includes a breaker contact that is normally in electrical contact with a load terminal. The breaker arm can be moved to break this electrical contact by deliberate movement of the breaker switch without disturbing the position of the trigger. Alternatively, the breaker arm can be moved to break the electrical contact with the load terminal by release of the trigger.

In one aspect of the breaker function, magnetic lever and armature arrangement is disposed between the line input and the floating breaker arm. The magnetic lever is operable to detect short circuit condition and to actuate the tripping lever to activate the trigger.

In a further feature, the circuit breaker includes a coil actuator that can actuate the tripping lever in a ground fault or an over-current condition. The tripping lever can thus be alternatively actuated by the coil actuator or the magnetic lever.

DESCRIPTION OF THE PREFERRED EMBODIMENT

Figure 1:
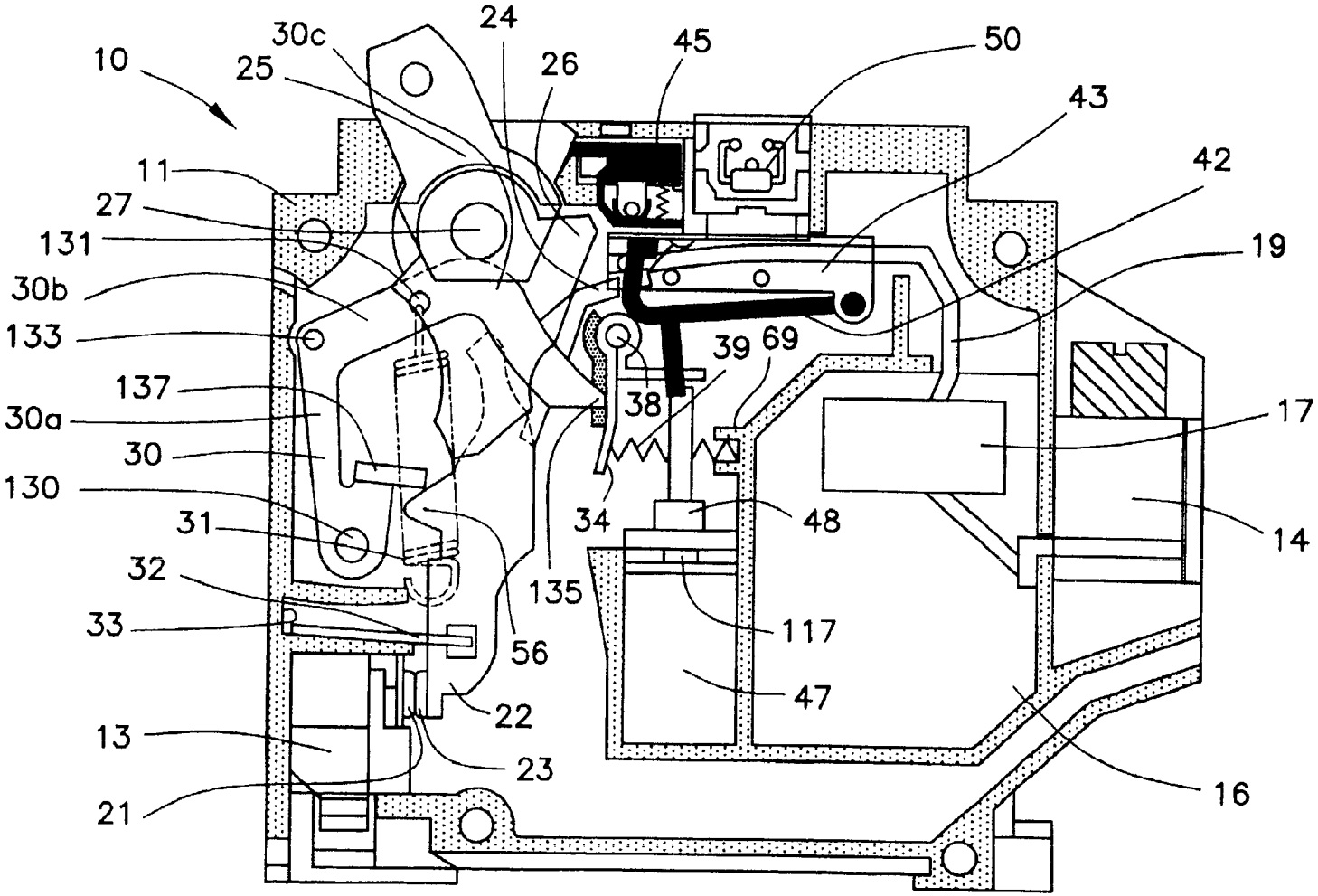
FIG. 1 is a side cutaway view of a circuit breaker in accordance with one embodiment of the invention, with the breaker in its normal operative configuration.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

In one embodiment of the invention, a circuit breaker 10 is provided that includes a housing 11 containing the various mechanical and electrical components of the breaker. A line terminal 13 is provided for connection to a line load, while a load terminal 14 permits electrical connection to a consumer load. A processor 16, which is preferably a microprocessor, is connected between the line and load terminals to monitor the condition of the electrical current flowing through the circuit breaker 10.

It is understood that the processor 16 can be of conventional design and that in the typical case the processor is not directly connected to the line input due to the high voltage and current of that input. Instead, the processor 16 relies upon signals from various sensors, such as current or voltage sensors, to accept a reduced voltage/current signal indicative of the electrical condition of the current flowing through the breaker. In the illustrated embodiment, a current transformer 17 can be provided to produce a low magnitude signal indicative of the breaker current. This signal can be provided to the processor 16 as well as to other components of the circuit breaker 10 as discussed herein.

The mechanical breaker components of the circuit breaker 10 include a stationary contact 21 that is electrically connected to the load terminal 13. A floating breaker arm 22 includes a moving contact 23 that is connected to an internal conductor or wire 19, which is preferably a shielded copper wire. This wire is connected to the line terminal 14 to pass electricity to the load terminal when the moving contact 23 engages the stationary contact 21. In the normal operating condition, the two contacts are engaged so that electricity flows freely through the circuit breaker 10. When an abnormal electrical condition arises, the flow of electricity is interrupted by disengaging the moving contact 23 from the stationary contact 21, in a manner that is well known in the art. In one embodiment, the conductor wire 19 can include an unshielded portion 24 that is connected to the floating breaker arm 22 in a manner described herein.

Figure 2:
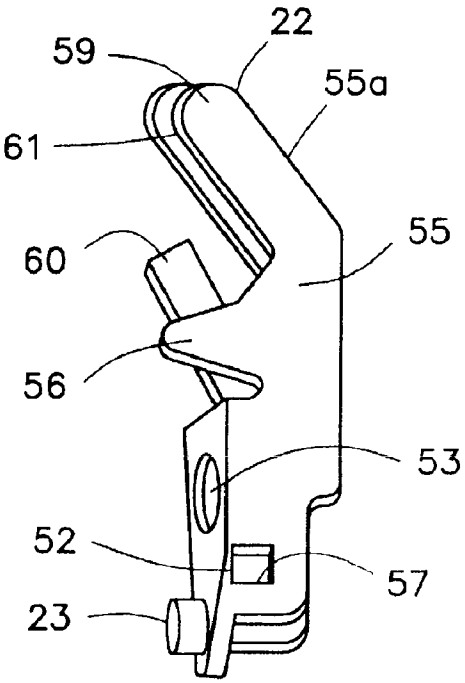
FIG. 2 is an enlarged side perspective view of a floating breaker arm included in the circuit breaker shown in FIG. 1.

More specifically, the breaker arm 22 can be constructed as shown in FIG. 2. The breaker arm 22 is preferably formed from a sheet of conductive material, such as tin-plated copper. The arm 22 is bent into a generally U-shape to define a top wall 52 and opposite side walls 55. The movable contact 23 is mounted to the top wall 52. One of the side walls 55 can include a tab 60 that can be crimped around the end of conductor wire 19 to provide an electrical interface to the breaker arm 22.

For purposes that will be explained in more detail below, the breaker arm 22 defines a spring slot 53 in the top plate 52 and an aperture 57 in one of the side walls 55. The U-shape formed by the opposite side walls 55 define a trigger channel 61 for receiving a trigger 30 therein. Each of the side walls 55 includes a fulcrum tip 59 and defines a cam edge 55*a*, as shown in FIG. 2. Moreover, one of the side walls forms a trigger contact 56, again for purposes more fully explained herein.

Figure 9:
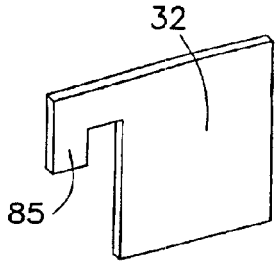
FIG. 9 is an enlarged side perspective view of an arc separator plate used with the floating breaker arm shown in FIG. 2.

One of the side walls 55 defines an aperture 57 that is used to support an arc separator plate 32. As shown in FIG. 9, the separator plate 32 forms a hook 85 that is received within the aperture 57. As shown in FIG. 1, the arc separator plate 32 slides within a channel 33 formed in the housing 11.

Figure 3:
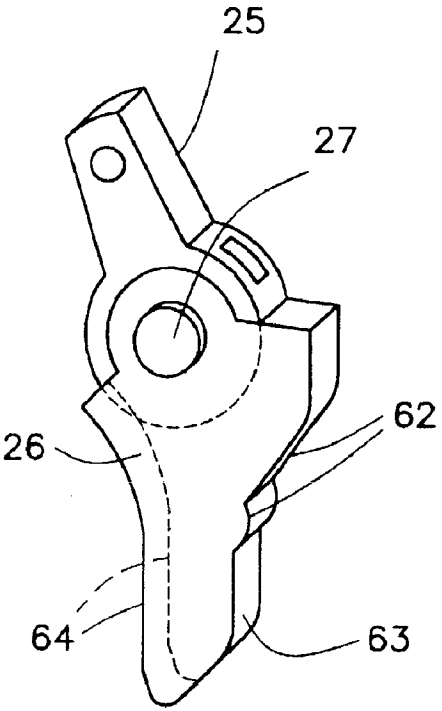
FIG. 3 is an enlarged side perspective view of a breaker switch included in the circuit breaker shown in FIG. 1.

The circuit breaker 10 also includes a breaker switch 25 that can be used to deliberately move the breaker from its "on" or active, to its "off" or disconnected state. In addition, the position of the switch serves as an indicator of the type of electrical fault sensed by the breaker. The switch 25 is pivotably mounted within the housing 11 by a pivot mount 27. As shown in more detail in FIGS. 3 and 4, the breaker switch includes a generally U-shaped pivot body 26 that is configured to straddle both the floating breaker arm 22 and the trigger 30. The pivot body, thus, includes opposite walls 62 that define a channel 63. At least one, and preferably both, of the opposite walls 62 defines a curved cam edge 64 for purposes explained below.

Figure 4:
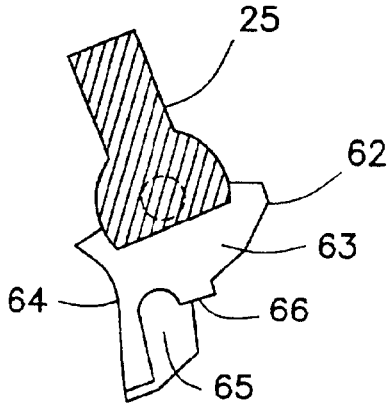
FIG. 4 is a cutaway partial cross-sectional view of the breaker switch shown in FIG. 3.

The switch is sectioned in FIG. 4 to illustrate interior features of the opposite walls 62. In particular, each wall defines a cam recess 65 and a pivot recess 66. The two recesses are configured to receive the fulcrum tips 59 of the floating breaker arm 22 and allow the tips, and consequently the arm, to pivot or cam freely within the switch 25. Preferably, the side walls 55 of the breaker arm 22 are separated by a width that permits a tight, but movable, fit between the fulcrum tips 59 and the recesses 65 and 66 of the pivot body 26.

Returning to FIG. 1, it can be seen that the circuit breaker 10 includes a trigger 30 that is pivotably mounted to the housing at a pivot end 130. The trigger can have the shape of a "horse hook" or a C-shaped bar, and is preferably stamped from a steel plate. Thus, the trigger can include a first leg 30*a* terminating in the pivot end 130, a second leg 30*b* that is at a generally obtuse angle relative to the first leg, and a third leg 30*c* that is itself at a generally obtuse angle relative to the second leg. The trigger 30 is oriented so that it can pivot within the channel 63 of the switch 25, as well as within the trigger channel 61 defined by the floating breaker arm 22.

The trigger 30 includes a trigger pin 133 that extends perpendicularly through the trigger plate at the corner between the first and second legs 30*a*, 30*b*. The third leg 30*c* terminates in a trigger tip 135 that engages a tripping lever 34, as described herein. A spring aperture 131 is defined in the second leg 30*b*, generally closer to the third leg 30*c* than the first leg 30*a*. The spring aperture 131 provides a connection point for one end of a spring 31, while the opposite end of the spring is connected to the floating breaker arm 22 at the spring slot 53, as depicted in FIG. 1. The spring 31 is a compression spring meaning that its natural tendency is to draw the second leg 30*b* of the trigger 30 and the breaker arm 22 together. In the normal operating condition shown in FIG. 1, the spring 31 is in tension.

Figure 5:
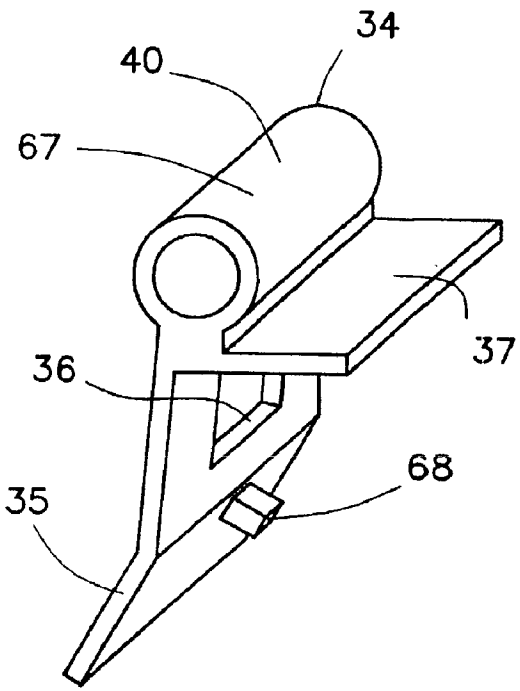
FIG. 5 is an enlarged side perspective view of a tripping lever included in the circuit breaker shown in FIG. 1.

The spring is held in tension and the mechanical breaker components maintained in their operative or "on" state shown in FIG. 1 by interaction between the trigger tip 135 and the tripping lever 34. Details of the tripping lever 34 can be found in FIG. 5. The lever includes a bushing 40 that receives a pivot pin 38 to pivotably mount the lever 34 within the housing 11. The lever includes a latch plate 35 that defines an aperture 36 to receive the trigger tip 135 therein. Extending substantially perpendicularly from the latch plate is a trip plate 37 that can be actuated by a tripper pin 48, shown in FIG. 1.The latch plate 35 includes a spring mount 68 projecting outward from the plate to support one end of a bias spring 39. The other end of the bias spring 39 is disposed within a spring retainer 69 formed in the housing 11. The bias spring 39 tends to push the latch plate 34 toward the trigger 30 to hold the trigger tip 135 within the latch aperture 36. Preferably, the tripping lever 34 is stamped and bent into shape from a steel plate, but can also be molded from nylon or other high rigidity material.

Figure 6:
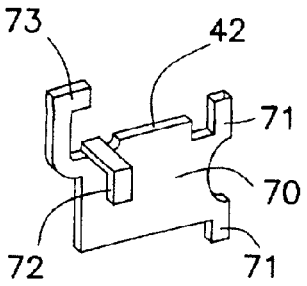
FIG. 6 is an enlarged side perspective view of a magnetic lever included in the circuit breaker shown in FIG. 1.
Figure 7:
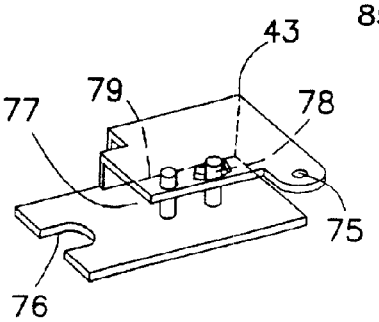
FIG. 7 is an enlarged side perspective view of a magnetic armature included in the circuit breaker shown in FIG. 1.

The circuit breaker 10 includes a magnetic lever and armature combination that senses a short circuit condition and operates to activate an indicator. In the illustrated embodiment, the breaker includes a magnetic lever 42 that is pivotably mounted to a magnetic armature 43. Details of these two components are shown in FIGS. 6 and 7, respectively. The lever 42 includes a generally rectangular plate 70 that flares outward at one end into opposite pivot arms 71.

As shown in FIG. 7, the armature 43 is a metal plate bent generally into a U-shape, with one wall of the plate defining a pivot mount 75. This mount 75 and a correspondingly configured mount in the housing 11 provide a pivot location for the two arms 71 of the lever 42. A locator notch 76 an opposite wall of the armature plate can be used to fasten the armature 43 to the housing.

As shown in FIG. 6, the magnetic lever 42 includes a tripping hook 72 projecting generally perpendicularly below the plate 70. As illustrated in FIG. 1, this hook is disposed about the trip plate 37 of the tripping lever 34 and can be used to actuate the lever, as described herein. Also projecting generally perpendicularly from the plate 70, but in an opposite orientation relative to the hook 72, is a lever arm 73. This lever arm is used to activate the fault indicator assembly 45 supported above the lever arm 73 within the housing 11.

Figure 8:
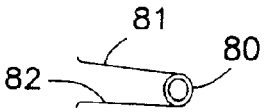
FIG. 8 is an enlarged side view of a torsion spring used with the magnetic lever and armature shown in FIGS. 6 and 7.

Returning to FIG. 7, the armature 43 is again generally U-shaped, forming an elongated channel 77. Spanning the channel and engaged to the opposite walls of the armature are two spaced pins 78 and 79 that are used to support and react a torsion spring, such as the spring 80 shown in FIG. 8. The coil of the spring 80 is mounted around the pin 78, while a reaction leg 81 of the spring bears against the second pin 79. The lever leg 82 of the spring 80 bears against the plate 70 of the magnetic lever 42 to bias the plate away from the armature 43.

The channel 77 and pins 78, 79 contain the conductor wire 19 extending through the armature 43. Current flowing through the wire 19 creates a magnetic flux through the armature 43 which tends to attract the magnetic lever 42. During a normal operating condition, this flux is not great enough to overcome the biasing force of the torsion spring 80, so the lever 42 is normally separated from the armature 43 as shown in FIG. 1.

However, when the lever 42 is attracted to the armature 43, the upward movement of the lever bears against a fault indicator assembly 45. Details of this assembly appear in FIG. 10. In particular, the assembly includes a housing 87 that supports a viewing window 88. One end of the housing defines a slider opening 90, while the opposite end of the housing is an open end 91 for insertion of the moving components of the indicator assembly. A pair of flanges 89 extend beneath the housing 87 to pivotably support an indicator carrier 103. The bottom wall of the housing 87 defines an opening 92 to receive the locking tab 106 of the carrier 103.

The carrier 103 includes a bushing 105 through which a pin 101 extends to pivotably mount the carrier to the flanges 89. The carrier includes a biasing arm 104 that includes an upwardly extending post 107 for receiving a biasing spring 109. This biasing spring pushes the arm 104 away from the housing, which causes the carrier 103 to pivot about the pin 101 to push the locking tab 106 upward through the opening 92 in the housing 88.

Figure 10:
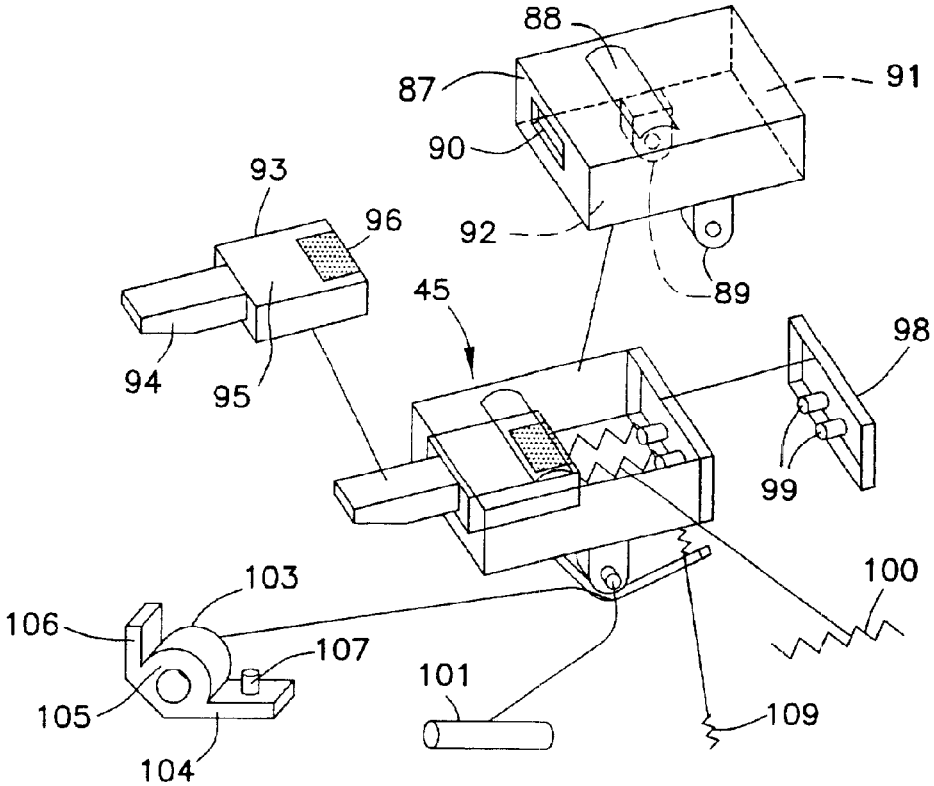
FIG. 10. is an exploded component view of a fault indicator assembly included in the circuit breaker shown in FIG. 1.

When the locking tab 106 is in this normally biased position, the tab bears against an indicator slider 93. The slider 93 is slidably disposed within the housing 88 and is biased toward one end of the housing by a pair of extension springs 100. A cover 98 closes the open end 91 of the housing and provides a reaction surface for the springs 100. Spring posts 99 can be provided to help support the extension spring 100. The slider 93 includes a tongue 94 that extends through the opening 90, as shown in FIG. 10, when a fault condition arises. However, in the normal operating position, the tongue 94 is substantially fully contained within the housing 88, held in place by the locking tab 106.

The upper face of the slider 93 includes two differently colored sections, the first section 95 having a first indicator color and the second section 96 having a second indicator color. Either section is visible beneath the viewing window 88 depending upon the position of the slider. In a preferred embodiment, the first indicator color is black and nominally indicates a normal operating condition. The second color in section 96 can be red to indicate a fault condition.

Figure 11:
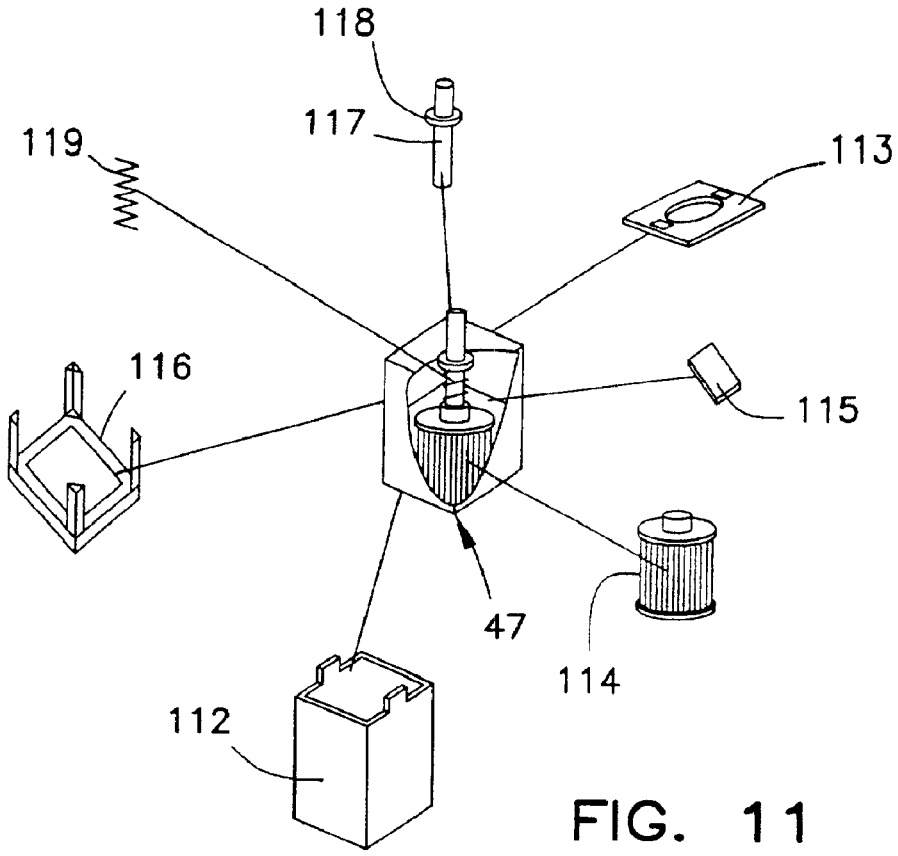
FIG. 11 is an exploded component view of a coil actuator assembly included in the circuit breaker shown in FIG. 1.

The exploded diagram in FIG. 11 depicts the elements of the magnetic tripper assembly 47. This assembly is supported within the housing 11 below the tripping lever 34, as shown in FIG. 1. The assembly 47 includes a housing 112 that supports an electromagnetic coil 114. The coil 114 is connected to the current transformer 17 or the processor 16 to receive current as a function of the line current at line terminal 13. Permanent magnets 115 are supported by holder 116 within the housing to complete the magnetic element of the assembly 47. The core 117 extends through the coil 114 and is spring biased toward the cover 113 of the housing by way of a spring 119 acting against a flange 118. A portion of the core 117 extends outside the cover 113 to engage a tripper pin 48. The tripper pin 48 is situated directly beneath the trip plate 37 of the tripping lever 34, as shown in FIG. 1. In the normal operating condition, the coil 114 maintains the core 117 retracted within the housing 112 so that the tripper pin 48 does not bear against the lever 34.

Figure 12:
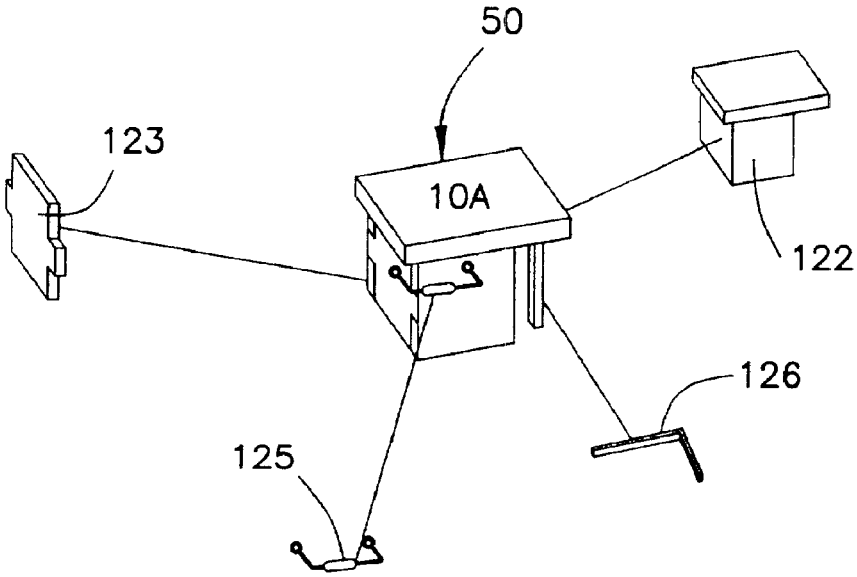
FIG. 12 is an exploded component view of a chip assembly included in the circuit breaker shown in FIG. 1.

The current rating or ground fault current specification for the circuit breaker 10 can be determined by way of a replaceable chip assembly 50, such as illustrated in FIG. 12. The assembly 50 can include a housing 122 with a removable cover 123 to provide access to a resistor or resistors 125 mounted therein. Contact pins 126 are electrically connected to the resistor(s) 125 and provide means for making electrical contact with a mounting pad of the processor 16. The replaceable chip assembly thus is integrated into the shaping and amplification circuitry of the processor to determine the tripping current conditions. The chips 50 can provide current rating from as low as 0.1 amps to as high as 125 amps and beyond by proper selection of the resistor(s) within the chip. Thus, a single circuit breaker 10 can be modified for virtually any electrical system application by the simple expedient of changing out the chip assembly 50.

Figure 16:
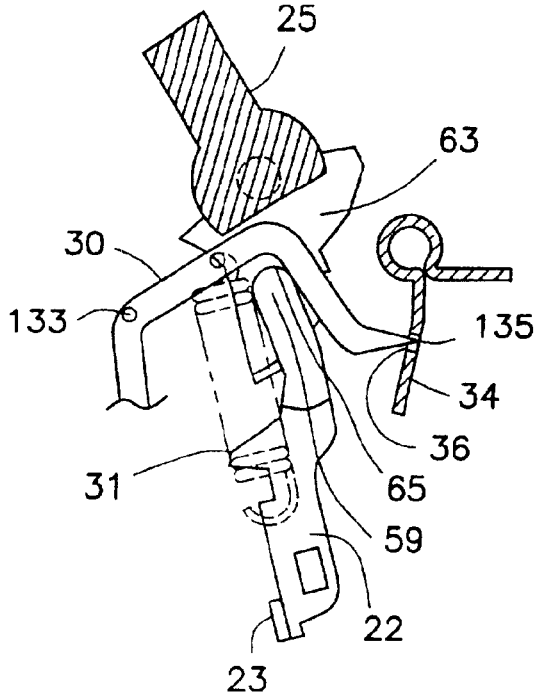
FIG. 16 is an enlarged side cutaway view of the mechanical breaker components in the normal or "on" configuration.

With the details of the breaker components described, attention can now turn to the function of these components. As indicated above, FIG. 1 depicts the breaker 10 in its normal operating condition—i.e., during normal current flow through the breaker. In this configuration, the two contacts 21 and 23 are in engagement. The position of the floating breaker arm 22 is maintained as shown in the detail view of FIG. 16. In this normal operating configuration, the trigger tip 135 of the trigger 30 is held in place by the tripping lever 34, with the tip 135 disposed within the aperture 36. The trigger 30 thus fixes the orientation of the spring 31 which tends to pull the floating breaker arm 22 upward toward the switch 25. More specifically, the spring 31 tends to force the fulcrum tip 59 of each side wall 55 of the breaker arm 22 into the cam recess 65 of the pivot body 26 of the switch 25.

The trigger contact 56 of the arm 22 bears against the fulcrum bar 137 of the trigger 30 to form a mechanical linkage between the floating breaker arm 22, spring 31 and cam recess 65. The line of action of the spring 31 in this orientation keeps the breaker arm in the orientation shown in FIG. 1 so that the electrical contacts remain in contact. The force of the fulcrum tip 59 of the breaker arm 22 upward against the cam recess 65 tends to pivot the switch 25 about its pivot mount 27 so that the switch handle is oriented to the left, as shown in FIG. 1. The switch handle can carry appropriate markings to indicate that the switch is in its "on" position when oriented to the left as shown in the figure.

Figure 17:
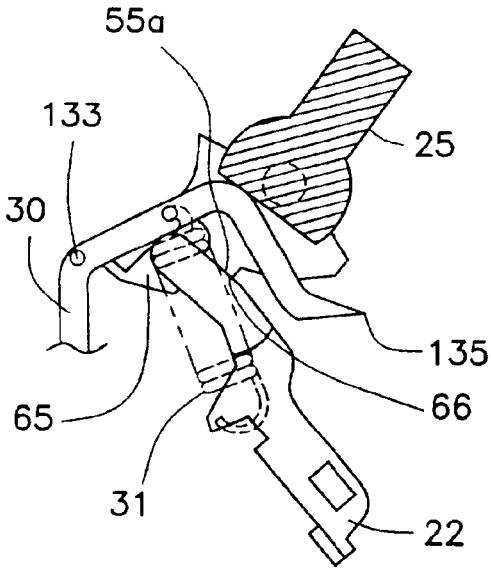
FIG. 17 is an enlarged side cutaway view of the mechanical breaker components in the "off" configuration.
Figure 13:
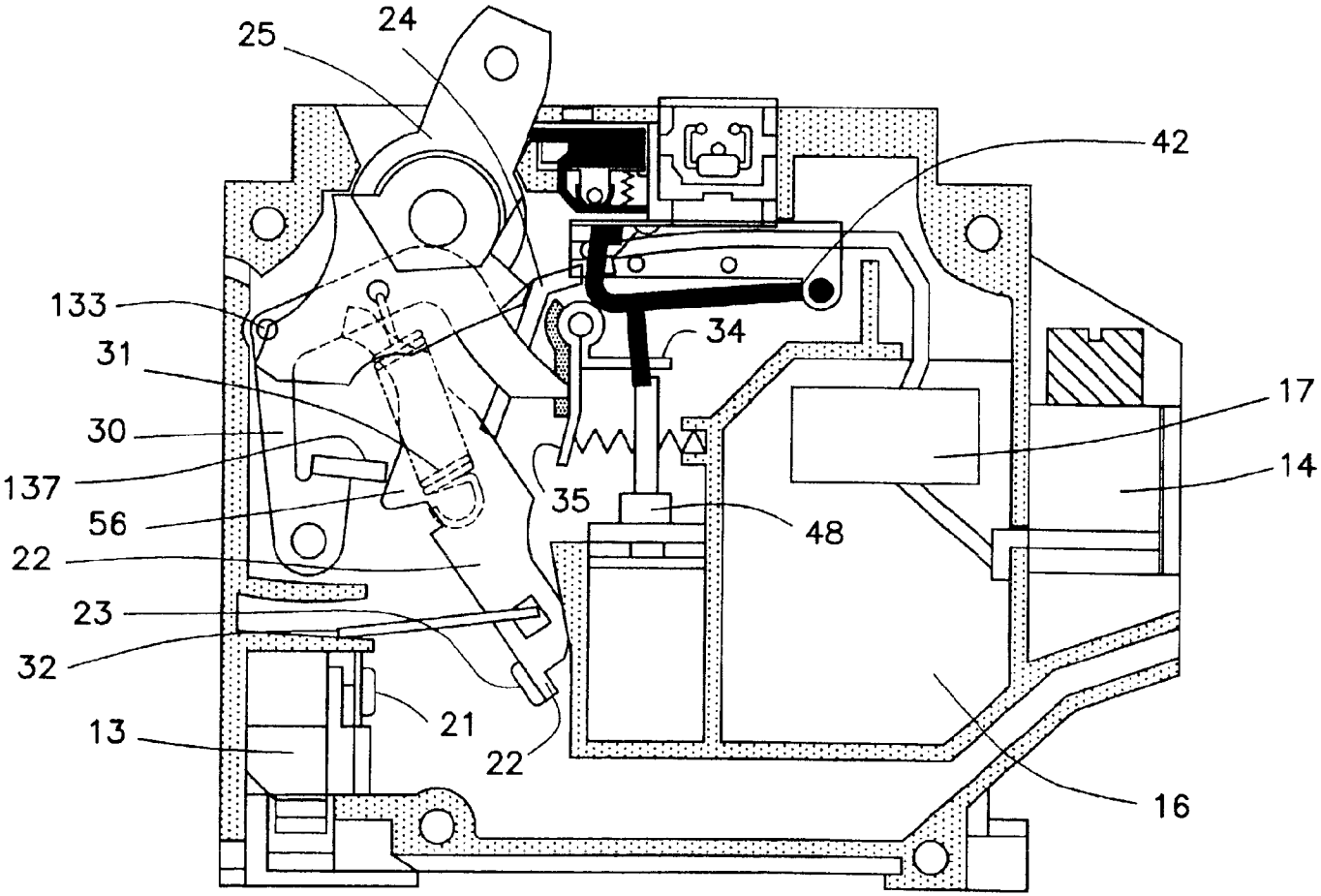
FIG. 13 is a side cutaway view of the circuit breaker shown in FIG. 1 with the breaker switch in its "off" position.

Referring now to FIGS. 13 and 17, the circuit breaker is depicted in the configuration arising when the breaker switch 25 is deliberated turned to its "off" position. In this position, the switch handle is oriented to the right, as shown in FIG. 13. Again, appropriate markings can provide an additional visual indication that the circuit breaker 10 has been shut off. As the breaker switch 25 is rotated about its pivot mount 27, the fulcrum tip 59 and bearing edge 55*a* of the floating breaker arm 22 bear against the cam recess 65 and pivot recess 66 of the switch 25. The trigger 30 is still maintained in its poised orientation, since no fault condition has occurred to trip the trigger. Thus, the trigger 30 provides a stationary anchor for the spring 31, while the fulcrum bar 137 of the trigger provides a stationary fulcrum point for movement of the breaker arm 22. As the switch rotates, the breaker arm 22 tends to pivot relative to the switch as the spring 31 tries to pull the breaker arm upward against the fulcrum bar 137. When the switch 25 is moved to its far right extent, the bearing edge 55*a* of the floating breaker arm 22 is pushed against the pivot recess of the switch. Again, the linkage cooperation between the fulcrum bar 137 and spring 31 hold the breaker arm 22 in the position shown in FIG. 13.

When the switch movement is reversed—i.e., when the switch is turned back to its "on" position shown in FIG. 1—the cam recess 65 pushes the fulcrum tip 59 of the breaker arm 22 to the right. The linkage formed by the fulcrum bar 137 and spring 31 will cause the breaker arm 22 to snap to its "on" position of FIG. 1 once the line of action between the cam recess 65 and fulcrum tip 59 moves to the right of the line of action of the spring 31.

Figure 18:
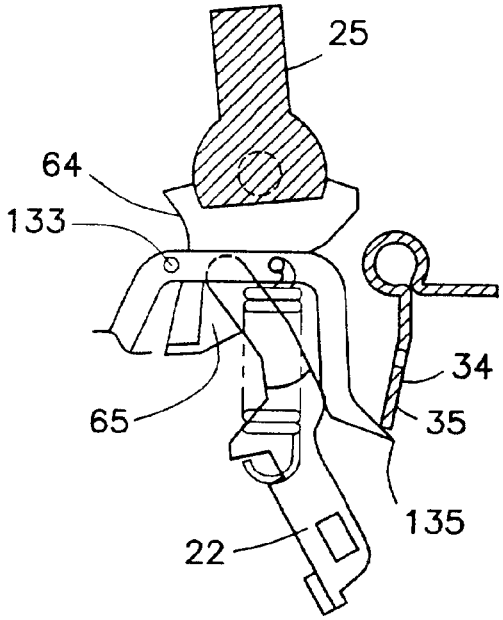
FIG. 18 is an enlarged side cutaway view of the mechanical breaker components in a trigger condition.
Figure 14:
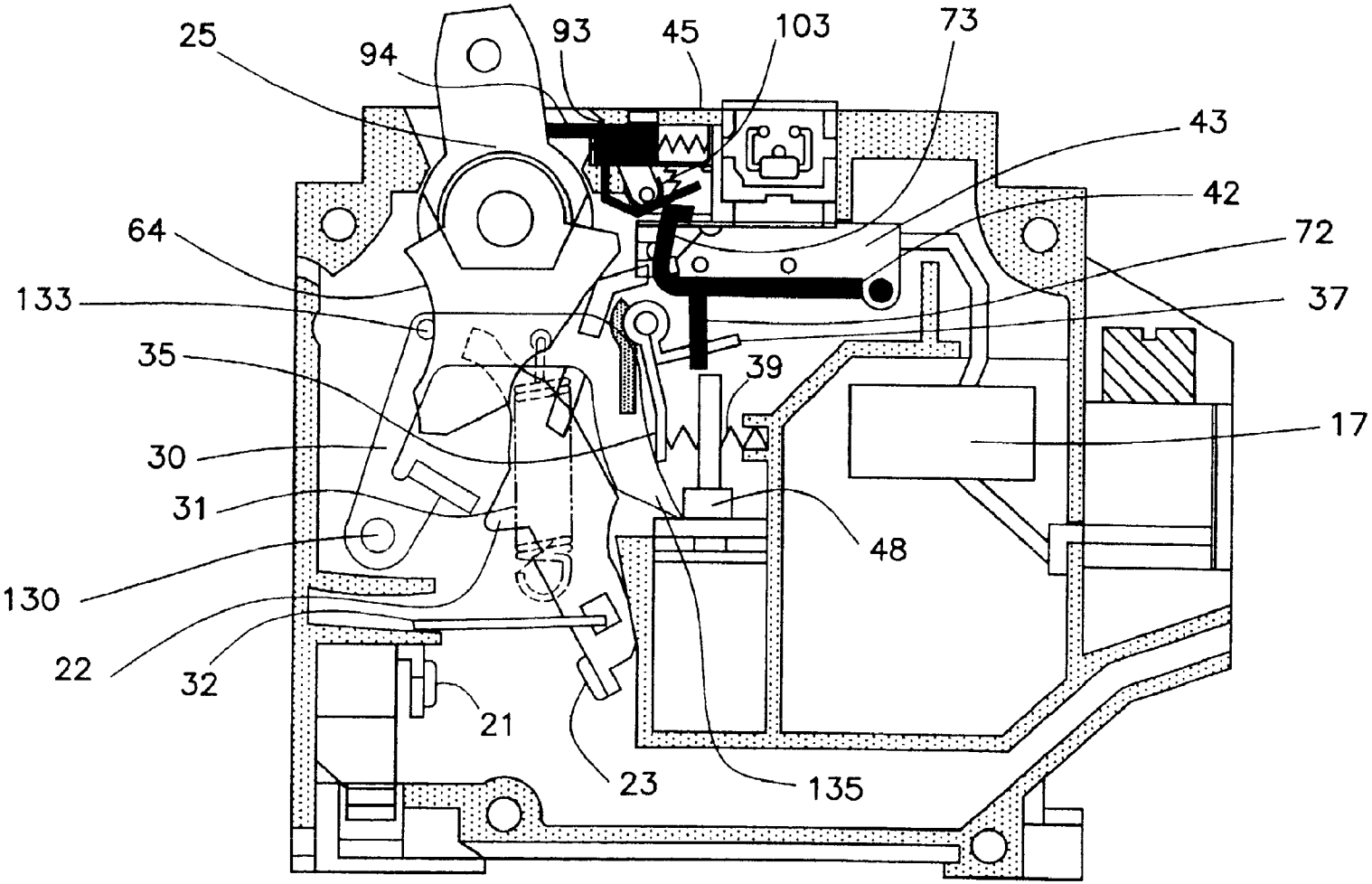
FIG. 14 is a side cutaway view of the circuit breaker shown in FIG. 1 in its configuration responding to a short circuit condition.

When a short circuit condition arises, the circuit breaker 10 moves to the configuration shown in FIGS. 14 and 18. In a short circuit condition, current flowing through the conductor wire 19 exceeds a predetermined limit. In this condition, the armature 43 produces a magnetic flux that is sufficient to overcome the biasing force of the torsion spring 80 to attract the magnetic lever 42. The lever 42 pivots upward so that the plate 70 contacts the armature 43. When the lever 42 pivots upward, the tripping hook 72 also moves upward until it contacts trip plate 37 of tripping lever 34. This upward movement causes the tripping lever 34 to rotate so that the latch plate 35 moves clear of the tip 135 of the trigger. More specifically, rotation of the tripping lever 34 releases the tip 135 from the aperture 36 in the latch plate.

With the tip 135 free to move, the spring 31 draws the trigger 30 and floating breaker arm 22 together. As the trigger 30 rotates about its pivot 130, the fulcrum bar 137 no longer restrains the movement of the breaker arm 22. Instead, the cam recess 65 and pivot recess 66 of the breaker switch 25 controls the upward movement and rotation of the arm 22. The breaker arm 22 is thus held in the position shown in FIG. 14 by abutment of its side walls 55 against the housing and by pressure of the fulcrum tip 59 against the switch pivot body 26. This pressure from the fulcrum tip also causes the switch to pivot slightly about its pivot mount 27 so that the switch moves to a neutral position, as shown in FIG. 14.

This rotation of the switch is also facilitated by pressure from the trigger pin 133 against the cam edge 64 of the pivot body 26. As the spring 31 tries to contract, it causes the trigger 30 to rotate until the pin 133 bears against the cam edge 64. This same contact is also used to reset the circuit breaker. In particular, when the fault condition has been resolved, the breaker can be reset by first rotating the switch to the right. This rotation of the switch causes the cam edge 64 to push against the trigger pin 133, thereby causing the trigger 30 to pivot about its pivot point 130. As the trigger continues to pivot, the trigger tip 135 bears against the latch plate 35 of the tripping lever, causing the lever to rotate about its own axis. Eventually, the trigger 30 has pivoted enough so that the tip 135 becomes lodged in the aperture 36, thereby resetting the trigger 30. The switch can then be rotated back to the left, to its "on" position, to force the floating breaker arm 22 into electrical contact with the stationary contact 21.

Referring back to FIG. 14, when the short circuit condition arises, it is certainly desirable to provide a visual indication of the condition to eliminate the risk of injury to the unwary. When the magnetic lever 42 pivots upward under the influence of the armature 43, as described above, the lever arm 73 also moves upward into contact with the indicator carrier 103, and more particularly against the bias arm 104. As explained above in connection with FIG. 10, this movement causes the carrier 103 to pivot, which causes the locking tab 106 to retract from the opening 92 in the indicator assembly housing 87. When the tab 106 has moved a sufficient distance, it disengages the slider 93 so that the spring 100 push the slider to the left in FIG. 14. With this movement, the tongue 94 extends out slider opening 90 so that the tongue contacts the breaker switch 25, as shown in FIG. 14. At the same time, this translation of the slider 93 moves the second color section 96 into position beneath the viewing window 88. Again, the second section 96 has a red color to provide an immediate and urgent indication of the fault condition. Thus, the circuit breaker 10 provides an indication of a short circuit condition by the red color of the indicator assembly 45 as well as the neutral position of the switch 25.

When the breaker is reset, the switch is first rotated to the right, as described above for resetting the trigger. This same movement also resets the fault indicator assembly 45. As the trigger is pivoted to the right, it pushes against the tongue 94, causing the slider 93 to retract within the housing 87. When the slider 93 has moved sufficiently far, the locking tab 106 can pivot upward under inducement from the biasing spring 109 until it locks the slider in the position shown in FIG. 1. It should be noted that while the fault condition exists, the magnetic lever 42 will remain in its upward position. When the lever is in this position, the lever arm 73 will continue to bear against bias arm 104 of the indicator carrier 103, which will prevent rotation of the carrier back to its original position. However, once the fault condition has been rectified, the torsion spring 80 will push the magnetic lever 42 back to its original position, thereby freeing the indicator carrier 103.

Figure 15:
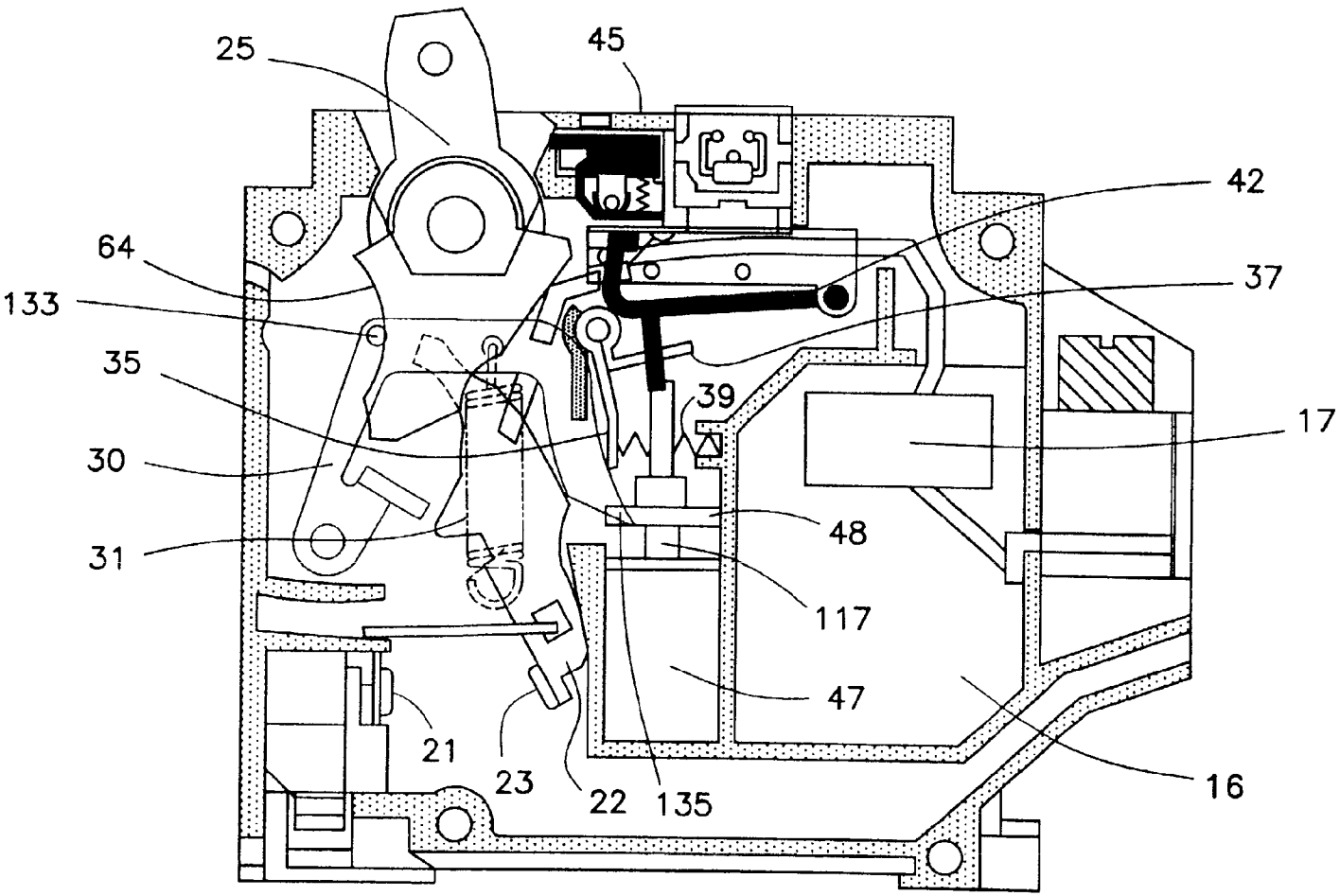
FIG. 15 is a side cutaway view of the circuit breaker shown in FIG. 1 in its configuration responding to an over-circuit condition.

An over-current fault is illustrated in FIG. 15. As explained above, the magnet tripper 47 is supplied with current from either the current transformer 17, or from the processor 16. Most preferably, the current is obtained from the processor through a relay. When the processor determines that an over-current condition exists (by evaluating the signal from the current transformer), it opens the relay which terminates current to the coil 114 of the magnet tripper 47. When the coil is inactive, the magnets 115 are released, which allows the core 117 to travel upward under influence from the spring 119. This upward movement is carried through by the tripper pin 48 until the pin contacts and rotates the trip plate 37 of the tripper lever 34. At this point, the movement of the lever 34 and the remaining mechanical components of the breaker continue as described above with respect to FIGS. 14 and 18.

Figure 19:
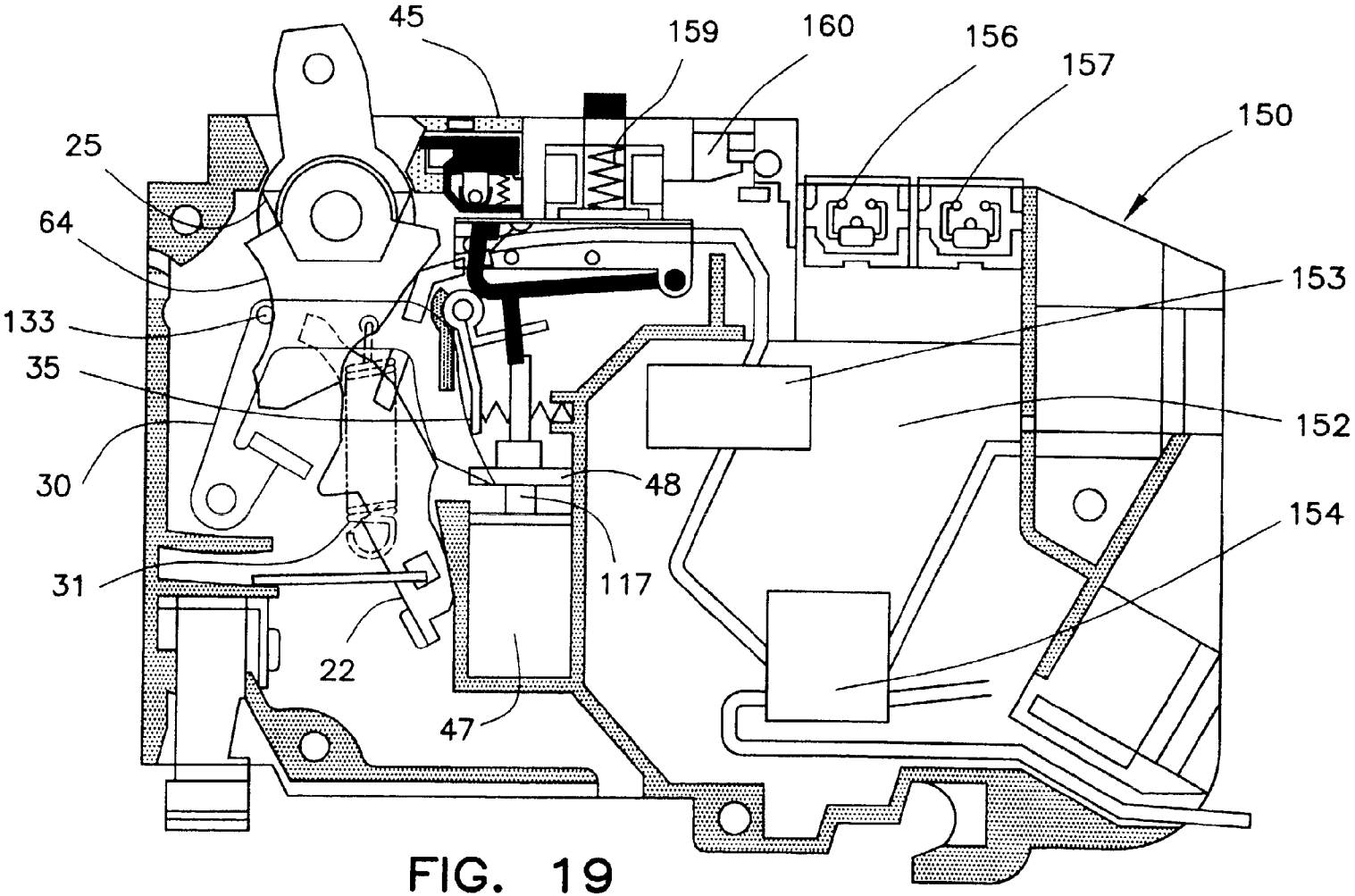
FIG. 19 is a side cutaway view of a circuit breaker in an alternative embodiment of the invention shown in a ground fault condition.

The present invention also contemplates a ground fault breaker and indicator system. Referring to FIG. 19, an alternative circuit breaker 150 is shown. This breaker can be substantially similar to the breaker 10 described above, with the addition of a ground fault indicator 159 and a zero current transformer (ZCT) 154. In fact, these components can be added to the breaker 10. With this ground fault responsive system, the processor 152 receives current signals from the current transformer 153 and the ZCT 154.

The ground fault indicator 159 can be constructed similar to the magnetic tripper 47. The top portion of the core 117 can be modified to carry certain indicia to signify a ground fault condition. The coil 114 of the magnet tripper and the comparable coil of the ground fault indicator can both be connected to the ZCT 154. When a ground fault condition arises, current through the ZCT ceases, thereby deactivating the two coils. When the magnetic tripper 47 coil is deactivated, the tripper pin 48 operates as explained above with respect to FIG. 15. In addition, when the coil of the ground fault indicator 159 is deactivated, the core 117 pops up, exposing the top portion of the core. In a preferred embodiment, the top portion of the core can be yellow in color or carry a yellow cap. When current is restored, the respective coils are re-energized and both the tripper pin 48 and yellow indicator are retracted to signify that the fault condition has been cleared. The circuit breaker 150 can be provided with a test switch 160 that allows personnel to temporarily interrupt current to the ground fault indicator 159 to verify its operability without tripping the mechanical components of the breaker and thereby disconnecting the load.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A circuit breaker having a housing, a line input terminal, and load output terminal and a stationary contact electrically connected to the load output terminal, comprising:

a mechanical trip mechanism including a contact electrically connected to the line input terminal by a conductor passing through the housing and a trigger element, said trip mechanism operable in a normal condition to hold said contact in engagement with the stationary contact and in a fault condition to disengage the contact from the stationary contact when the trigger element is actuated;

a tripping lever pivotably mounted within the housing and including a latch plate operable to engage said trigger element when said trip mechanism is in said normal condition and movable to release said trigger element when said tripping lever is pivoted relative to the housing, said tripping lever including a trip plate configured to pivot said tripping lever upon movement of said trip plate;

an over-current sensor having an actuator operable to move said trip plate when a first fault condition is sensed;

a short circuit sensor, independent of said over-current sensor, said short circuit sensor having a second actuator operable to move said trip plate when a second fault condition is sensed wherein said short circuit sensor comprises an armature disposed about said conductor and operable to produce a magnetic flux in response to current flowing through said conductor, a magnetic lever movably mounted within the housing to move toward said armature in response to said magnetic flux, said lever including a portion for engaging said trip plate when said magnetic lever moves toward said armature, and a biasing member for biasing said magnetic lever away from said armature; and a fault indicator actuated by movement of said magnetic lever toward said armature, said fault indicator comprising a housing defining a viewing window, a slider slidably mounted within said housing and having differently colored portions alternatively visible through said viewing window, one of said portions signifying a short circuit condition, a means for biasing said slider with said one portion aligned with said window, and a movable locking tab arranged to hold said slider against said means for biasing, wherein said magnetic lever includes an arm operable to move said locking tab away from said slider when said magnetic lever moves toward said armature.

2. The circuit breaker of claim 1 further comprising an electrical processor electrically connected to the line input terminal and operable to monitor a condition of an electrical current flowing from the line input terminal to the load output terminal, to activate said over-current sensor when said first fault condition is sensed, and to activate said short circuit sensor when said second fault condition is sensed.

3. The circuit breaker of claim 2 further comprising a replaceable chip assembly electrically connectable to said electrical processor to establish a current rating for said breaker, wherein said current rating is a function of at least one electrical element within said replaceable chip assembly such that said replaceable chip assembly can be replaced by a second replaceable chip assembly having a different electrical element to establish a different current rating for said breaker.

4. The circuit breaker of claim 3 wherein said at least one electrical element is at least one resistor, the value of which establishes said current rating.

5. The circuit breaker of claim 3 wherein said replaceable chip assembly comprises:

an assembly housing removably mounted within the housing of the circuit breaker, said assembly housing supporting said at least one electrical element; and a plurality of contact pins electrically connected at one end to said at least one electrical element and configured at an opposite site end thereof for removable electrical connection to said electrical processor.

6. The circuit breaker of claim 1 wherein said trip mechanism comprises:

a breaker switch pivotably mounted within the breaker housing;

an elongated floating breaker arm electrically connected to the line input terminal and including a contact at one end of said arm configured to make electrical contact with the stationary contact, said opposite end configured for variable pressure engagement with said breaker switch;

a trigger pivotably mounted at a pivot end thereof to the housing and including a trigger tip at an opposite end of said trigger;

a latch mounted within the housing and configured to releasably engage said trigger tip to prevent pivoting of said trigger;

a spring connected at one end thereof to said trigger between said pivot end and said opposite end of said trigger, and said spring connected at its opposite end to said floating breaker arm, said spring operable to draw said trigger and said breaker arm together along a first line of action defined by said spring;

a fulcrum contact between said trigger and said floating breaker arm, said fulcrum contact oriented between said one end of said spring and said contact on said breaker arm, said fulcrum contact and said variable pressure engagement defining a second line of action, whereby pivoting of said breaker switch changes the relative orientation of said first line of action and said second line of action, in which said contact of said breaker arm engages the stationary contact when said first line of action is between said contact and said second line of action, and said contact of said breaker arm disengages the stationary contact when second line of action is between said contact and said first line of action.

7. The circuit breaker of claim 6, wherein said latch includes a latch plate pivotably mounted to the housing, said plate defining an aperture for removably receiving said trigger tip therethrough.

8. The circuit breaker of claim 7, wherein said latch includes a trip plate connected to said latch plate, said trip plate configured to be actuated by a fault sensor within the housing to pivot said latch relative to said trigger to release said trigger tip from said aperture.

* * * * *